US009039319B2

(12) United States Patent
Oetken

(10) Patent No.: US 9,039,319 B2
(45) Date of Patent: May 26, 2015

(54) MODIFYING COMPACTION EFFORT BASED ON MATERIAL COMPACTABILITY

(71) Applicant: Caterpillar Paving Products Inc., Brooklyn Park, MN (US)

(72) Inventor: Nicholas A. Oetken, Brooklyn Park, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 61 days.

(21) Appl. No.: 13/930,160

(22) Filed: Jun. 28, 2013

(65) Prior Publication Data

US 2015/0003911 A1 Jan. 1, 2015

(51) Int. Cl.

| | |
|---|---|
| ***E01C 23/07*** | (2006.01) |
| ***E01C 19/38*** | (2006.01) |
| ***E01C 19/28*** | (2006.01) |

(52) U.S. Cl.

CPC ..... *E01C 19/288* (2013.01)

(58) Field of Classification Search

USPC ..... 404/84.05, 84.1, 117, 122, 103, 123, 404/124, 112, 130

See application file for complete search history.

(56) References Cited

U.S. PATENT DOCUMENTS

| | | | | |
|---|---|---|---|---|
| 4,127,351 | A * | 11/1978 | Vural | 404/72 |
| RE31,195 | E * | 4/1983 | Thurner | 73/573 |
| 4,870,601 | A * | 9/1989 | Sandstrom | 702/43 |
| 6,122,601 | A * | 9/2000 | Swanson et al. | 702/137 |
| 6,236,923 | B1 * | 5/2001 | Corcoran et al. | 701/50 |
| 6,241,420 | B1 * | 6/2001 | Perrin et al. | 404/84.1 |
| 6,431,790 | B1 * | 8/2002 | Anderegg et al. | 404/75 |
| 6,460,006 | B1 * | 10/2002 | Corcoran | 702/137 |
| 6,551,019 | B1 * | 4/2003 | Motz et al. | 404/117 |
| 6,750,621 | B2 | 6/2004 | Gandrud | |
| 6,973,821 | B2 * | 12/2005 | Corcoran | 73/78 |
| 7,168,885 | B2 * | 1/2007 | Rio et al. | 404/72 |
| 7,428,455 | B2 * | 9/2008 | Corcoran | 701/50 |
| 7,591,608 | B2 | 9/2009 | Hall et al. | |
| 8,116,950 | B2 * | 2/2012 | Glee | 701/50 |
| 2003/0048082 | A1 * | 3/2003 | Gandrud | 318/128 |
| 2004/0009039 | A1 * | 1/2004 | Corcoran et al. | 404/117 |
| 2005/0183512 | A1 * | 8/2005 | Corcoran | 73/818 |
| 2007/0150147 | A1 * | 6/2007 | Rasmussen et al. | 701/50 |
| 2010/0215434 | A1 * | 8/2010 | Wolf | 404/117 |
| 2011/0097148 | A1 | 4/2011 | Potts et al. | |
| 2011/0293369 | A9 * | 12/2011 | Commuri | 404/117 |
| 2012/0107045 | A1 * | 5/2012 | DeClerk et al. | 404/75 |
| 2012/0134746 | A1 | 5/2012 | Wallrath et al. | |

FOREIGN PATENT DOCUMENTS

| | | |
|---|---|---|
| EP | 2148005 | 1/2010 |

* cited by examiner

*Primary Examiner* — Abigail A Risic
(74) *Attorney, Agent, or Firm* — Andrew A. Phillips

(57) ABSTRACT

A vibratory compactor having a first compacting element having a variable vibratory mechanism that sets a modifiable compaction effort, a second compacting element, a first sensor configured to measure a first surface compactability associated with the first compacting element, a second sensor configured to measure a second surface compactability associated with the second compacting element and a control system. The control system is configured to receive the first surface compactability, receive the second surface compactability, determine a target compaction effort for the first compacting element based on the first surface compactability and the second surface compactability, and modify the variable vibratory mechanism to set the compaction effort at the target compaction effort.

20 Claims, 1 Drawing Sheet

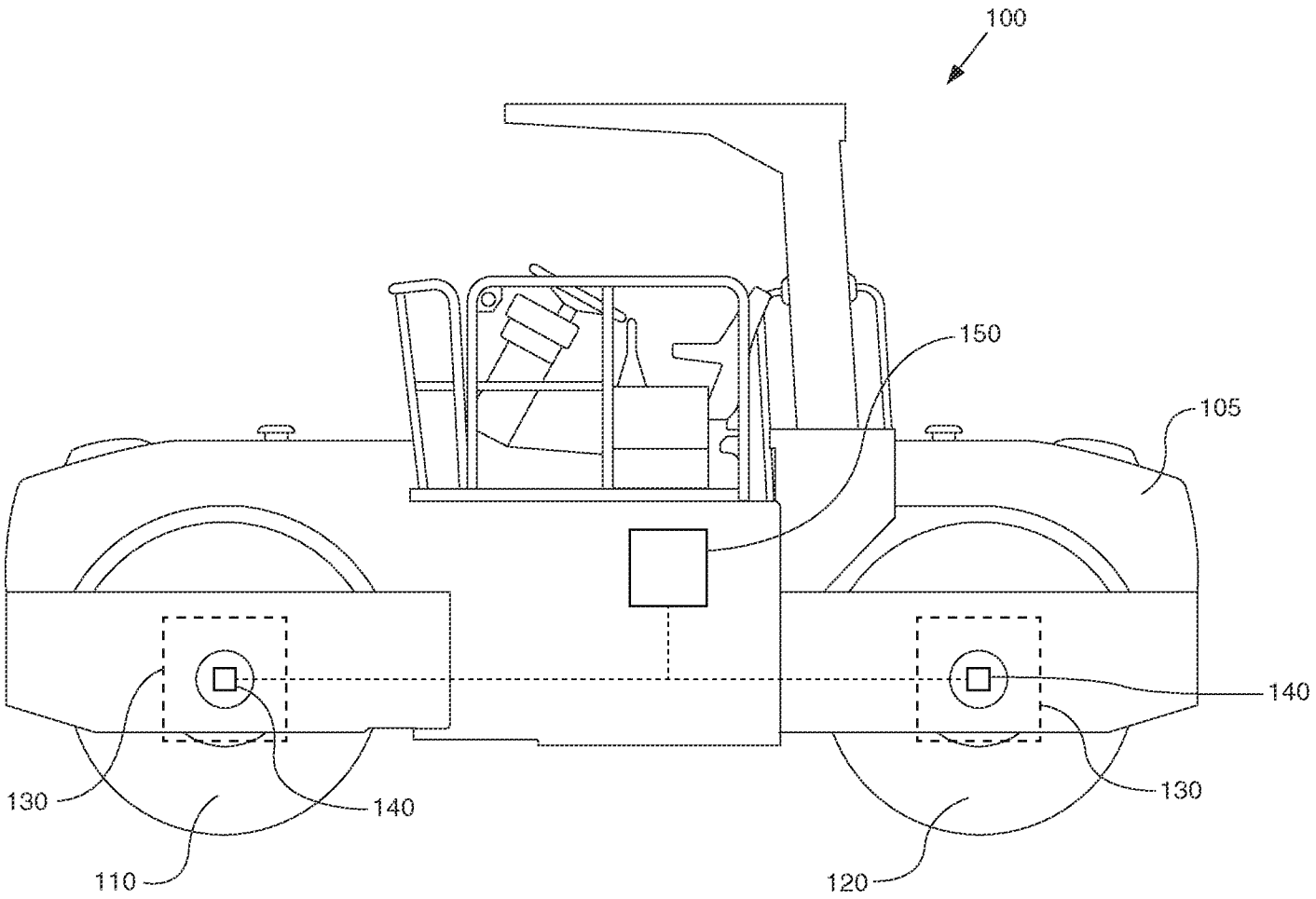
100
105
150
140
130
120
140
110
130

MODIFYING COMPACTION EFFORT BASED ON MATERIAL COMPACTABILITY

TECHNICAL FIELD

The present disclosure relates generally to automating the compaction process for a vibratory compactor. More particularly, the present disclosure relates to monitoring a data parameter and modifying the compaction effort of a trailing drum of the vibratory compactor based on the data parameter.

BACKGROUND

Compactor machines, also variously called compaction machines, are frequently employed for compacting fresh laid asphalt, dirt, gravel, and other compactable materials associated with road surfaces. For example, during construction of roadways, highways, parking lots and the like, loose asphalt is deposited and spread over the surface to be paved. One or more compactors, which may be self-propelling machines, travel over the surface whereby the weight of the compactor compresses the asphalt to a solidified mass. The rigid, compacted asphalt has the strength to accommodate significant vehicular traffic and, in addition, provides a smooth, contoured surface that may facilitate traffic flow and direct rain and other precipitation from the road surface. Compactors are also utilized to compact soil or recently laid concrete at construction sites and on landscaping projects to produce a densified, rigid foundation on which other structures may be built.

One such type of compaction machine is a drum-type compactor having one or more drums adapted to compact particular material over which the compactor is being driven. In order to compact the material, the drum-type compactor, or vibratory compactor, includes a drum assembly having a variable vibratory mechanism that, for example, includes inner and outer eccentric weights arranged on a rotatable shaft situated within a cavity of the inner eccentric weight. Both amplitude and frequency of vibration (also referred to as compaction effort) are typically controlled to establish the degree of compaction. Amplitude is often controlled by a transversely moveable linear actuator adapted to axially bear against an axially translatable key shaft, causing the key shaft to rotate. The rotation of the key shaft in turn alters relative positions of the inner and the outer eccentric weights to vary amplitude of vibration created within the drum. Frequency of vibration is controlled by changing the speed of a drive motor positioned within the compactor drum. Compaction effort is modified by either modifying the amplitude, frequency, or amplitude and frequency.

Typical vibratory compactors have either a single drum with a variable vibratory mechanism or two drums each having a variable vibratory mechanism. By way of example, U.S. Pat. No. 6,750,621 shows a vibratory compactor having two drums with variable vibratory mechanisms. Sensors not connected to the drums are used to collect certain vibratory characteristics about each drum and adjust the compaction effort of the drum to a selected setting. The control unit also calculates the difference between the measured vibratory characteristics on both the front and rear drums. The system disclosed by the '621 patent is a reactive system in which the compaction effort is continually adjusted based on the measured vibratory characteristics being different from the selected vibratory settings. The sensors are not measuring the compactability of the surface material and not proactively responding to the compactability of the surface material. As a result, it is possible to decompact or crush the surface material due to high compaction effort from the drum onto the surface material. The present disclosure is directed to one or more of the problems or issues set forth above.

SUMMARY OF THE DISCLOSURE

In one aspect, a vibratory compactor includes a frame, a first cylindrical drum coupled to the frame and having a modifiable first compaction effort, a second cylindrical drum coupled to the frame and having a modifiable second compaction effort, a first sensor coupled to the first cylindrical drum and configured to sense a first surface compactability, a second sensor coupled to the second cylindrical drum and configured to sense a second surface compactability, and a control system. The control system is configured to receive the first surface compactability and the second surface compactability, determine a first target compaction effort, and modify the first compaction effort to the first target compaction effort; receive the second surface compactability, determine a second target compaction effort, and modify the second compaction effort to the second target compaction effort; receive the first surface compactability and the second surface compactability to determine a third target compaction effort, and modify the first compaction effort to the third target compaction effort; and receive the first surface compactability and the second surface compactability to determine a fourth target compaction effort, and modify the second compaction effort to the fourth target compaction effort.

In another aspect, a vibratory compactor has a first compacting element having a variable vibratory mechanism that sets a modifiable compaction effort, a second compacting element, a first sensor configured to measure a first surface compactability associated with the first compacting element, a second sensor configured to measure a second surface compactability associated with the second compacting element and a control system. The control system is configured to receive the first surface compactability, receive the second surface compactability, determine a target compaction effort for the first compacting element based on the first surface compactability and the second surface compactability, and modify the variable vibratory mechanism to set the compaction effort at the target compaction effort.

In yet another aspect, a method of vibratory compaction includes providing a vibratory compactor assembly that has a first cylindrical drum having a variable vibratory mechanism that sets a modifiable compaction effort and a second cylindrical drum. The method further includes rotating the first cylindrical drum, rotating the second cylindrical drum, measuring a first surface compactability associated with the first cylindrical drum, measuring a second surface compactability associated with the second cylindrical drum, determining a target compaction effort for the first cylindrical drum based on the first surface compactability and the second surface compactability, and modifying the compaction effort with the variable vibratory mechanism to the target compaction effort.

BRIEF DESCRIPTION OF THE DRAWINGS

FIG. 1 is a side view of a compactor, according to an exemplary embodiment of the present disclosure.

DETAILED DESCRIPTION

This disclosure relates generally to a vibratory compactor machine having one or more roller drums that are in rolling contact with a surface to be compacted. A compactor is generally used in situations where loose surface material, characterized as material which can be further packed or densified, is disposed over the surface. As the compactor machine travels over the surface, vibrational forces generated by the compactor machine and imparted to the surface, acting in cooperation with the weight of the machine, compress the loose material to a state of greater compaction and density. The compactor machine may make one or more passes over the surface to provide a desired level of compaction. In one intended application, the loose material may be freshly deposited asphalt that is to be compacted into roadways or similar hardtop surfaces. However, in other applications, the material may be soil, gravel, sand, land fill trash, concrete or the like.

An exemplary embodiment of a compaction machine 100 is shown generally in FIG. 1. Compaction machine 100, which is shown as a vibratory compactor, may be any machine used to compact a surface material. Compaction machine 100 has a frame 105, a first compacting element 110 (or first cylindrical drum 110), and a second compacting element 120 (or second cylindrical drum 120). Both first compacting element 110 and second compacting element 120 are rotatably coupled to frame 105 so that first and second compacting elements 110, 120 roll over the surface material as compaction machine 100 travels.

It will be appreciated that first compacting element 110 can have the same or different construction as second compacting element 120. In particular, first compacting element 110 is an elongated, hollow cylinder with a cylindrical drum shell that encloses an interior volume. The cylindrical roller drum extends along and defines a cylindrical drum axis. To withstand being in rolling contact with and compacting the surface material, the drum shell can be made from a thick, rigid material such as cast iron or steel. While the illustrated embodiment shows the surface of the drum shell as having a smooth cylindrical shape, in other embodiments, a plurality of bosses or pads may protrude from the surface of the drum shell to, for example, break up aggregations of the material being compacted.

Both first compacting element 110 and second compacting element 120 may have a variable vibratory mechanism 130. While FIG. 1 shows both first and second compacting elements 110, 120 having variable vibratory mechanisms 130, in other embodiments only one of first and second compacting elements 110, 120 may have variable vibratory mechanism 130. In other words, the present disclosure is applicable to compaction machine 100 having (1) first and second compacting elements 110, 120 both having variable vibratory mechanism 130, (2) first compacting element 110 having variable vibratory mechanism 130 and second compacting element 120 not having variable vibratory mechanism 130; and (3) second compacting element 120 having variable vibratory mechanism 130 and first compacting element 110 not having variable vibratory mechanism 130.

Variable vibratory mechanism 130 is disposed inside the interior volume of the roller drum. According to one exemplary embodiment, variable vibratory mechanism 130 includes one or more weights or masses disposed inside the roller drum at a position off-center from the axis line around which the roller drum rotates. As the roller drum rotates, the off-center or eccentric positions of the masses induce oscillatory or vibrational forces to the drum that are imparted to the surface being compacted. The weights are eccentrically positioned with respect to the common axis and are typically movable with respect to each other about the common axis to produce varying degrees of imbalance during rotation of the weights. The amplitude of the vibrations produced by such an arrangement of eccentric rotating weights may be varied by positioning the eccentric weights with respect to each other about their common axis to vary the average distribution of mass (i.e., the centroid) with respect to the axis of rotation of the weights. Vibration amplitude in such a system increases as the centroid moves away from the axis of rotation of the weights and decreases toward zero as the centroid moves toward the axis of rotation. Varying the rotational speed of the weights about their common axis may change the frequency of the vibrations produced by such an arrangement of rotating eccentric weights. In some applications, the eccentrically positioned masses are arranged to rotate inside the roller drum independently of the rotation of the drum. The present disclosure is not limited to these embodiments described above. According to other alternative embodiments, any variable vibratory mechanism 130 that modifies the compaction effort of a first compacting element 110 or a second compacting element 120 may be used.

Variable vibratory mechanism 130 controls the compaction effort for first and second compacting elements 110, 120. By altering the distance of the eccentric weights from the axis of rotation in variable vibratory mechanism 130, the amplitude portion of the compaction effort is modified. By altering the speed of the eccentric weights around the axis of rotation in variable vibratory mechanism 130, the frequency portion of the compaction effort is modified. Additionally, both the amplitude portion and the frequency portion of the compaction effort of variable vibratory mechanism 130 can be modified by changing both the distance of the eccentric weights from the axis of rotation and the speed of rotation of the eccentric weights around the axis of rotation at the same time.

According to one exemplary embodiment, a sensor 140 is located on each of first compacting element 110 and second compacting element 120. In alternative embodiments, multiple sensors 140 may be located on first compacting element 110 and second compacting element 120. According to other alternative embodiments, sensors 140 need not be located on first compacting element 110 and second compacting element 120 but could be located on frame 105. Alternatively, sensors 140 could be located on both frame 105, first compacting element 110, and second compacting element 120. Sensors 140 measure the compactability of the surface material, and there is at least one sensor associated with each of first compacting element 110 and second compacting element 120. The compactability of the surface material is based on the characteristics of the surface material being compacted along with the characteristics of the compacting element. So, for example, the compactability of the surface material sensed by sensor 140 coupled to first compacting element 110 will measure the characteristics of the surface material proximate to first compacting element 110, such as type of material, material density, etc., and the characteristics of first compacting element 110, such as amplitude, frequency, speed of the eccentric weights, distance of the eccentric weights from the axis of rotation, speed of rotation of the drum, etc. It is not necessary to measure all of the data parameters listed, these are listed for exemplary purposes. One of skill in the art will appreciate that there are numerous sensors 140 or combination of sensors 140 to accomplish this purpose, and any of them will suffice.

The surface compactability sensed by sensors 140 for first compacting element 110 and second compacting element 120 is communicated to a control system 150. Control system 150 utilizes the surface compactability measurements to adjust the compaction effort of one or both of first compacting element 110 and second compacting element 120. Control system 150 is coupled to sensors 140 either through wired or wireless communication methods known in the art. Control system 150 is also coupled to variable vibratory mechanisms 130 either through wired or wireless communication methods known in the art. Control system 150 calculates target compaction efforts and modifies the compaction effort of variable vibratory mechanisms 130 in first compacting element 110 and second compacting element 120 to achieve target compaction efforts as described further herein.

INDUSTRIAL APPLICABILITY

The present disclosure finds potential application in, among other potential applications, any compaction machine 100 that has first compacting element 110 and second compacting element 120, and where at least one of first compacting element 110 and second compacting element 120 has variable vibratory mechanism 130. In particular, the present disclosure assists in preventing decompaction and crushing the surface material from high compaction effort during the compaction process. The present disclosure does this by measuring the surface compactability proximate to first compacting element 110 and second compacting element 120 with sensors 140 and determining target compaction efforts for at least one of first compacting element 110 and second compacting element 120.

In one embodiment, compacting machine 100 has first compacting element 110 and second compacting element 120. Only second compacting element 120 has variable vibratory mechanism 130. In this case, even though compacting machine 100 can travel with both second compacting element 120 as the leading or trailing drum, the most benefit from the present disclosure is achieved when second compacting element 120 is the trailing drum. Both first compacting element 110 and second compacting element 120 send the surface compactability measurements from their respective sensors 140 to control system 150. Control system 150 takes the surface compactability measurement from sensor 140 associated with first compacting element 110 and the surface compactability measurement from sensor 140 associated with second compacting element 120 and determines a target compaction effort for second compacting element 120. Control system 150 then modifies the compaction effort of second compacting element 120 to the target compaction effort. This minimizes decompaction and crushing of the surface material.

In another embodiment, compacting machine 100 has both first compacting element 110 and second compacting element 120 each having a variable vibratory mechanism 130. Control system 150 determines whether first compacting element 110 or second compacting element 120 is the leading drum. Alternatively, control system 150 determines whether first compacting element 110 or second compacting element 120 is the trailing drum. This determination can be made either by operator input, accelerometer, position sensor, or numerous other methods apparent to one of skill in the art. In this case, the leading drum will have its compaction effort modified only by its associated sensor 140 and the corresponding surface compactability measurement. The trailing drum, however, will have its compaction effort modified by the surface compactability measurements taken by sensors associated with both the leading and trailing drums. Control system 150 will determine a target compaction effort for the trailing drum based on both surface compactability measurements and will modify the trailing drum's compaction effort to that target compaction effort.

In practice, control system 150 determines four different target compaction efforts. The first target compaction effort is for first compacting element 110 using the surface compactability measurement taken from sensor 140 associated with it. The second target compaction effort is for second compacting element 120 using the surface compactability measurement taken from sensor 140 associated with it. The third target compaction effort is for first compacting element 110 using the surface compactability measurement taken from sensor 140 associated with it, as well as sensor 140 associated with second compacting element 120. The fourth target compaction effort is for second compacting element 120 using the surface compactability measurement taken from sensor 140 associated with it, as well as sensor 140 associated with first compacting element 110. Control system 150 will modify the compaction effort for first compacting element 110 using either the first target compaction effort or the third target compaction effort depending on whether first compacting element 110 is the leading or trailing drum. Likewise, control system 150 will modify the compaction effort for second compacting element 120 using either the second target compaction effort or the fourth target compaction effort depending on whether second compacting element 120 is the leading or trailing drum.

In an alternative embodiment, where compaction machine 100 has first compacting element 110 with variable vibratory mechanism 130 and second compacting element 120 with variable vibratory mechanism 130, control system 150 determines four machine states. In the first machine state, control system 150 modifies the compaction effort of first compacting element 110 based only on the surface compactability measurement taken from its associated sensor 140 and modifies the compaction effort of second compacting element 120 based only on the surface compactability measurement taken from its associated sensor 140. In the second machine state, control system 150 modifies the compaction effort of first compacting element 110 based only on the surface compactability measurement taken from its associated sensor 140 and modifies the compaction effort of second compacting element 120 based on the surface compactability measurements taken from its associated sensor 140 as well as sensor 140 associated with first compacting element 110. In the third machine state, control system 150 modifies the compaction effort of first compacting element 110 based on the surface compactability measurements taken from its associated sensor 140 as well as sensor 140 associated with second compacting element 120 and modifies the compaction effort of second compacting element 120 based only on the surface compactability measurement taken from its associated sensor 140. In the fourth machine state, control system 150 modifies the compaction effort of first compacting element 110 based on the surface compactability measurements taken from its associated sensor 140 as well as sensor 140 associated with second compacting element 120 and modifies the compaction effort of second compacting element 120 based on the surface compactability measurements taken from its associated sensor 140 as well as sensor 140 associated with first compacting element 110. Alternatively, control system 150 may be disabled so that it is either not sensing the various machines states or not modifying the compaction efforts of first and second compacting elements 110, 120 according to the machine states. According to other various alternative embodiments, control system 150 may sense and carry out only one or more of the four machine states. For example, control system 150 may be set up to only carry out one of the four described machine states.

Using the surface compactability measurement from sensor 140 of the leading drum of compaction machine 100 to determine a target compaction effort for variable vibratory mechanism or mechanisms 130 minimizes decompaction and crushing of the compacted surface material. The present disclosure thereby assists in further automating the compaction process and the overall paving process, and leads to reduced labor costs and helping the operators reduce potentially costly errors in the compaction and paving processes.

While the present disclosure describes the surface compactability measurement as determining the compaction effort of first compacting element 110 and second compacting element 120, in operation, the surface compactability measurement may not be the only factor used to determine the desired and actual compaction effort of first compacting element 110 and second compacting element 120. Many other characteristics and data parameters known to a person of skill in the art go into determining the compaction effort put out by the variable vibratory mechanism 130. The present disclosure contemplates the use of other factors beyond the surface compactability measurements, in determining the compaction effort. Instead, it may be one of one or more factors.

It should be understood that the above description is intended for illustrative purposes only, and is not intended to limit the scope of the present disclosure in any way. Thus, those skilled in the art will appreciate that other aspects of the disclosure can be obtained from a study of the drawing, the disclosure, and the appended claims.

What is claimed is:

1. A vibratory compactor comprising:

a frame;

a first cylindrical drum having a modifiable first compaction effort, wherein the first cylindrical drum is coupled to the frame;

a second cylindrical drum having a modifiable second compaction effort, wherein the second cylindrical drum is coupled to the frame and disposed behind the first cylindrical drum;

a first sensor coupled to the first cylindrical drum and configured to sense a first surface compactability;

a second sensor coupled to the second cylindrical drum and configured to sense a second surface compactability;

a control system configured to:

receive the first surface compactability, determine a first target compaction effort, and modify the first compaction effort to the first target compaction effort;

receive the second surface compactability, determine a second target compaction effort, and modify the second compaction effort to the second target compaction effort;

receive the first surface compactability and the second surface compactability to determine a third target compaction effort, and modify the first compaction effort to the third target compaction effort; and receive the first surface compactability and the second surface compactability to determine a fourth target compaction effort, and modify the second compaction effort to the fourth target compaction effort.

2. The vibratory compactor of claim 1, wherein the control system is further configured to determine a plurality of machine states.

3. The vibratory compactor of claim 2, wherein the plurality of machines states are a first machine state, a second machine state, a third machine state, and a fourth machine state.

4. The vibratory compactor of claim 3, wherein in the first machine state the control system is configured to modify the first compaction effort to the first target compaction effort and modify the second compaction effort to the fourth target compaction effort.

5. The vibratory compactor of claim 3, wherein in the second machine state the control system is configured to modify the first compaction effort to the third target compaction effort and modify the second compaction effort to the second target compaction effort.

6. The vibratory compactor of claim 3, wherein in the third machine state the control system is configured to modify the first compaction effort to the first target compaction effort and modify the second compaction effort to the second target compaction effort.

7. The vibratory compactor of claim 3, wherein in the fourth machine state the control system is configured to modify the first compaction effort to the third target compaction effort and modify the second compaction effort to the fourth target compaction effort.

8. The vibratory compactor of claim 1, wherein the first compaction effort is modified by a first variable vibratory mechanism.

9. The vibratory compactor of claim 8, wherein the second compaction effort is modified by a second variable vibratory mechanism.

10. A vibratory compactor, the vibratory compactor comprising:

a first compacting element having a variable vibratory mechanism that sets a modifiable compaction effort;

a second compacting element; and at control system configured to:

determine whether the first compacting element or the second compacting element is a trailing compacting element;

determine a target compaction effort for the first compacting element based on the trailing compacting element determination; and modify the variable vibrators mechanism to set the compaction effort at the target compaction effort.

11. The vibratory compactor of claim 10, wherein the second compacting element comprises a second variable vibratory mechanism that sets a second modifiable compaction effort.

12. The vibratory compactor of claim 11, wherein the control system is further configured to:

determine a second target compaction effort for the second compacting element based on the trailing compacting element determination; and modify the second variable vibratory mechanism to set the second compaction effort at the second target compaction effort.

13. The vibratory compactor of claim 12, further comprising:

a first sensor configured to measure a first surface compactability; and a second sensor configured to measure a second surface compactability.

14. The vibratory compactor of claim 13, wherein the control system is further configured to:

receive the first surface compactability; and receive the second surface compactability.

15. The vibratory compactor of claim 14, wherein the target compaction effort is based on the first surface compactability when the trailing compacting element determination determines that the second compacting element is trailing.

16. The vibratory compactor of claim 15, wherein the target compaction effort is based on the first surface compactability and the second surface compactability when the trailing compacting element determination determines the first compacting element is trailing.

17. The vibratory compactor of claim 16, wherein the second target compaction effort is based on the second surface compactability when the trailing compacting element determination determines that the first compacting element is trailing.

18. The vibratory compactor of claim 17, wherein the second target compaction effort is based on the first surface compactability and the second surface compactability when the trailing compacting element determination determines that the second compacting element is trailing.

19. A vibratory compactor, the vibratory compactor comprising:

a first compacting element having a first modifiable compaction effort;

a second compacting element having a second modifiable compaction effort; and a control system configured to:

determine whether the first compacting element or the second compacting element is a trailing compacting element;

determine a first target compaction effort for the first compacting element based on the trailing compacting element determination;

determine a second target compaction effort for the second compacting element based on the trailing compacting element determination;

modify the first modifiable compaction effort to the first target compaction effort; and modify the second modifiable compaction effort to the second target compaction effort.

20. The vibratory compactor of claim 19, further comprising:

a first sensor associated with the first compacting element configured to measure a first surface compactability; and a second sensor associated with the second compacting element configured to measure a second surface compactability;

the control system is further configured to:

receive the first surface compactability; and receive the second surface compactability;

wherein the first target compaction effort is based on the first surface compactability when the trailing compacting element determination determines that the second compacting element is trailing;

the first target compaction effort is based on the first surface compactability and the second surface compactability when the trailing compacting element determination determines that the first compacting element is trailing;

the second target compaction effort is based on the second surface compactability when the trailing compacting element determination determines that the first compacting element is trailing; and the second target compaction effort is based on the first surface compactability and the second surface compactability when the trailing compacting element determination determines that the second compacting element is trailing.

* * * * *